US008038340B2

(12) United States Patent
Schneider

(10) Patent No.: US 8,038,340 B2
(45) Date of Patent: Oct. 18, 2011

(54) TIMEPIECE

(75) Inventor: Jens Schneider, Glashuette-Johnsbach (DE)

(73) Assignee: Lange Uhren GmbH, Glashütte (DE)

( * ) Notice: Subject to any disclaimer, the term of this patent is extended or adjusted under 35 U.S.C. 154(b) by 625 days.

(21) Appl. No.: 12/206,213

(22) Filed: Sep. 8, 2008

(65) Prior Publication Data

US 2009/0067296 A1 Mar. 12, 2009

(30) Foreign Application Priority Data

Sep. 7, 2007 (DE) ..... 10 2007 042 797

(51) Int. Cl.
*G04B 15/00* (2006.01)
*G04B 23/00* (2006.01)
*G04B 19/02* (2006.01)

(52) U.S. Cl. ..... 368/124; 368/147; 368/220

(58) Field of Classification Search ..... 368/124–125, 368/127, 139, 140, 145, 147, 220
See application file for complete search history.

(56) References Cited

U.S. PATENT DOCUMENTS

| | | | | |
|---|---|---|---|---|
| 240,287 | A * | 4/1881 | Vogel | 368/151 |
| 416,804 | A * | 12/1889 | Prentiss | 368/151 |
| 4,408,898 | A | 10/1983 | Vuilleumier et al. | |
| 6,863,434 | B2 * | 3/2005 | Mojon | 368/127 |
| 6,997,602 | B2 * | 2/2006 | Mojon et al. | 368/127 |
| 2004/0156273 | A1 * | 8/2004 | Mojon et al. | 368/127 |
| 2005/0088918 | A1 | 4/2005 | Journe | |
| 2005/0152225 | A1 | 7/2005 | Dias | |
| 2007/0127319 | A1 * | 6/2007 | Goeller | 368/124 |
| 2007/0147179 | A1 * | 6/2007 | Girardin et al. | 368/147 |

FOREIGN PATENT DOCUMENTS

| | | |
|---|---|---|
| DE | 1 086 635 | 8/1960 |
| EP | 0 029 204 | 6/1983 |
| EP | 1 406 131 | 4/2004 |
| EP | 1 528 443 | 5/2005 |
| EP | 1 772 783 | 4/2007 |
| EP | 1 795 976 | 6/2007 |

* cited by examiner

*Primary Examiner* — Vit Miska
(74) *Attorney, Agent, or Firm* — Cozen O'Connor

(57) ABSTRACT

A timepiece comprising a main energy storing device, a gear train coupled to the main energy storing device, a tensioning element coupled to the gear train, the tensioning element configured to be driven about a tensioning axis in cyclic steps, a tensioning control system configured to control the tensioning element, a storage hairspring having a first end and a second end, the first end connected to the tensioning element, a wheel connected to the second end of the storage hairspring, a clockwork movement rotatably driven by the wheel, an escapement coupled to the clockwork movement and a device configured to be switched in a stepwise manner and driven rotatably in cyclic steps by an element of the gear train.

18 Claims, 11 Drawing Sheets

TIMEPIECE

BACKGROUND OF THE INVENTION

1. Field of the Invention

The invention relates to a timepiece, in particular to a watch, with a main energy-storing device, by means of which a tensioning element of a tensioning mechanism can be driven via a gear train in a rotatable manner about a tensioning axis controlled in cyclic steps by means of a tensioning control system that tensions a storage hairspring connected at one end to the tensioning element, the other end of the storage hairspring is connected to a wheel which rotatably drives the clockwork movement and is in engagement with the gear mechanism of the escapement.

2. Description of the Related Art

In timepieces, the storage hairspring is tensioned by the same amount, at equal-sized time intervals defined by the mechanism. The oscillating system of the timepiece is thus supplied with a constant torque that is required if the main energy-storing device is subject to large torque fluctuations. The cause of the torque fluctuations can be, for example, a long period of running of the timepiece, or additional components of the timepiece, which are driven by the main energy-storing device, or components which have a fluctuating torque requirement.

SUMMARY OF THE INVENTION

These torque fluctuations are substantially eliminated by the tensioning mechanism, whereby the accuracy of the timepiece is improved. As a result of the control system of the tensioning mechanism, the driving part of the clockwork movement does not move uniformly, but in angular steps. The size of these steps is defined by the transmission ratio of the respective gear mechanism. The time intervals are determined by the control system of the tensioning mechanism. The driven part is driven by the storage hairspring and moves substantially uniformly.

One embodiment of the invention provides a timepiece of the type stated in the introduction, which allows an extension of the functions.

According to one embodiment of the invention a further device which is switchable in a stepwise manner and preferably driven rotatably in cyclic steps by an element of the gear train from the main energy-storing device to the tensioning element.

The cyclic steps for tensioning the hairspring, which are generated by the tensioning control system, can thus be used for other functions that are controlled in cyclic steps. This leads to a reduction in the necessary installation space.

Given a temporally exact working of the tensioning control system, a minute wheel can be driven rotatably in cyclic steps directly or indirectly by the element of the gear train, whereby a so-called "jumping minute" is obtained, in which the hand always points to a minute mark of a minute scale.

Preferably, the tensioning element is driven rotatably in a cyclic manner in minute steps and the further device which can be switched in a stepwise manner is a minute hand drive having a minute pinion which bears a minute hand driven rotatably by 6° steps.

To ensure an exact hand setting, the minute pinion can bear a 60-tooth minute ratchet wheel, in the tooth spaces of which a minute detent of a minute detent spring is configured to be engaged.

In one embodiment, a detent mechanism is fitted on a further shaft engaging the minute pinion.

In one embodiment, the minute pinion bears a gearwheel, which, via a change gear, drives an hour wheel bearing an hour hand rotatably at about one revolution per hour.

In one embodiment, further auxiliary devices are driven by the minute pinion, such as, for example, a minute repeat mechanism, or an alarm mechanism that can be triggered accurately to the minute.

A further use of the temporally exact working of the tensioning control system is that in one embodiment an hour wheel can be driven rotatably in cyclic steps directly or indirectly by the element of the gear train.

A one-handed timepiece can thus be realized, which maintains the ageless and calming character of such a timepiece and nevertheless allows the time to be read down to a few seconds.

In one embodiment, the main storing device is preferably disposed in the middle of the timepiece and is connected to the hour hand, an hour pinion being able to be driven rotatably, for example, by the main storing device in 144 cyclic 5-minute steps of 2.5°.

For the exact hand setting of the hour indicator, the hour pinion can, in this case, bear a 144-tooth hour ratchet wheel, in the tooth spaces of which an hour detent of an hour detent spring engages.

It is also possible for an hour cannon to be driven rotatably by the main storing device in 72 cyclic 10-minute steps of 5°, the hour pinion being able to bear a 72-tooth hour ratchet wheel, in the tooth spaces of which an hour detent of an hour detent spring can be engaged.

In one embodiment, the driven running mechanism is driven by the storage hairspring and possesses a shaft, which turns 5 or 10 minutes at a time and bears a minute hand, the minutes between the switching steps of the hour hand can be clearly read, since the minute hand moves continuously.

One embodiment of the temporally exact working of the tensioning control system includes a numerical dial of a digital time display can be driven rotatably in cyclic steps directly or indirectly by the element of the gear train. The numerical dial can here be, for example, a minute numerical dial and/or an hour numerical dial.

Given the limited installation space, to allow a large representation of the digits, a units-digit dial bearing units digits and a tens-digit dial bearing tens digits, which are arranged parallel to each other, can be driven rotatably about a numerical dial axis by the element of the gear train.

Preferably, the main energy-storing device is a barrel.

The tensioning element can be a third wheel and the wheel rotatably driving the clockwork movement can be a second third wheel, which is arranged coaxially to the first third wheel and which is rotatable by a limited angle relative to the first third wheel.

An exact cycle control is realized by the fact that a wheel of the clockwork movement disposed in a rotationally secure manner on a first spindle can be driven rotatably by the second third wheel, the first spindle bearing a control element by which a control part can be actuated, which is engageable in a gearwheel engaging with the first third wheel.

The wheel of the clockwork movement, which is disposed on the first spindle, can here be a second wheel.

An embodiment leading to an exact cycle control comprises an impulse pin arranged on the first spindle, which rotates with the first spindle and can be engaged in a fork at one end of a first arm of a lever, wherein the lever is pivotable counter to a spring force, by means of the impulse pin engaging in the fork, out of a first end setting into a second end setting about a pivot axis parallel to the first spindle, with a second arm of the lever, which has a first blocking element that is pivotable into the tooth peripheral region of one of the teeth of a first single-toothed or multi-toothed wheel, with a third arm of the lever, which has a second blocking element that is pivotable into the peripheral region of the teeth of a second single-toothed or multi-toothed wheel, wherein the first wheel and the second wheel can be driven rotatably by the first third wheel, wherein in the first end setting of the lever the first blocking element is pivoted into the tooth peripheral region of the first wheel and the second blocking element is pivoted out of the tooth peripheral region of the second wheel, and wherein in the second end setting of the lever the second blocking element is pivoted into the tooth peripheral region of the second wheel and the first blocking element is pivoted out of the tooth peripheral region of the first wheel.

For the precise positioning of the lever in its first end setting, the pivotability of the lever in the first end setting can be limited by a stop.

For the adjustment of this end setting, the stop can be displaced in the direction of the pivot motion of the lever.

For the precise adjustment of the position of the teeth of the first wheel, the first single-toothed or multi-toothed wheel can be disposed on a second spindle parallel to the first spindle so as to be adjustable twistably about the second spindle.

The position of the teeth of the second wheel is adjustable because the second single-toothed or multi-toothed wheel is disposed on a third spindle parallel to the first spindle so as to be adjustable twistably about the third spindle.

In one embodiment, the impulse pin on the first spindle can be adjustable twistably about the first spindle. This is possible with simple construction by virtue of the fact that the impulse pin is connected to the first spindle by means of a friction coupling.

To ensure that the fork falls away from the impulse pin in an exact manner, the impulse pin can have a positioning edge parallel to the first spindle, by which the fork can be pivotably acted upon.

In one embodiment, at the free end of the first arm of the lever, in a parallel plane to the fork, a blade part is provided, which extends in the direction of longitudinal extent of the lever and, while the fork is free from action by the impulse pin, bears with its free end against a cam connected in a rotationally secure manner to the impulse pin, then an untimely movement of the lever, triggered by vibrations, is prevented.

In order to dampen the motion of the tensioning, a rotation-damping device, which can be a fly-vane mounted rotatably about a vane axis, can be driven by the second wheel.

The various features, which characterize the invention, are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PRESENTLY PREFERRED EMBODIMENTS

Figure 12:
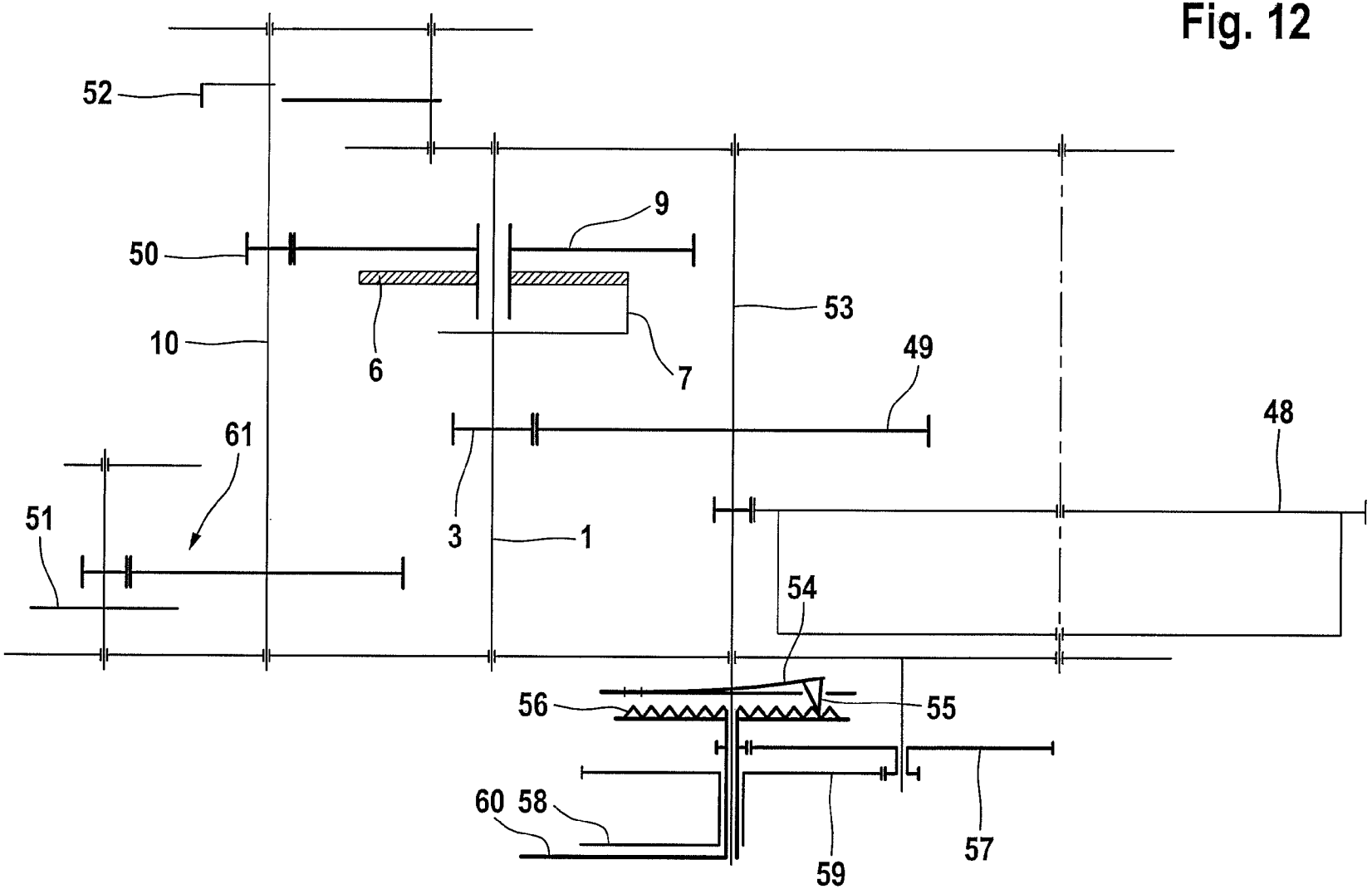
FIG. 12 is a schematic representation of the drive mechanism of a jumping minute hand of a timepiece.
Figure 13:
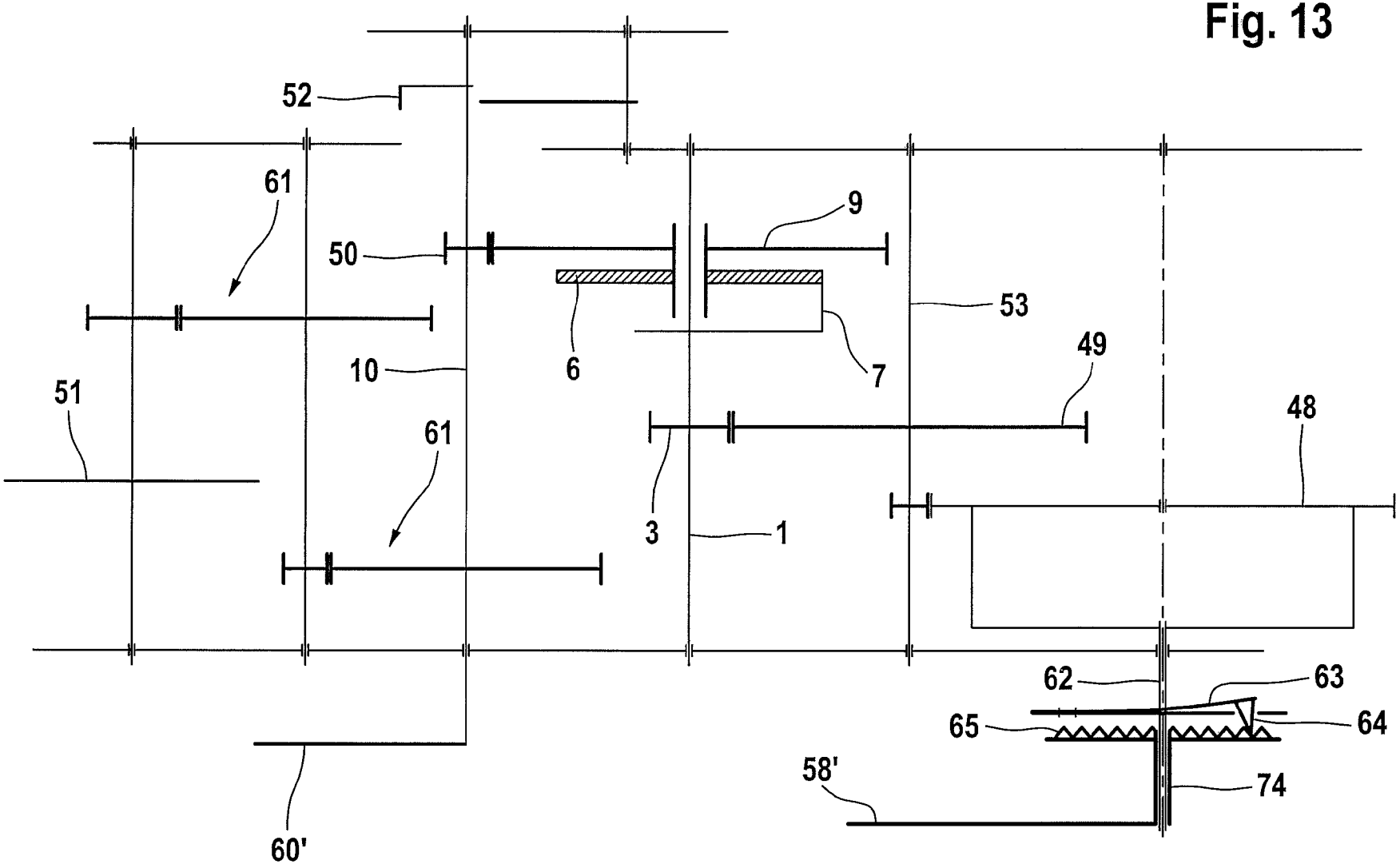
FIG. 13 is a schematic representation of the drive mechanism of a one-handed timepiece with eccentric minute hand.
Figure 14:
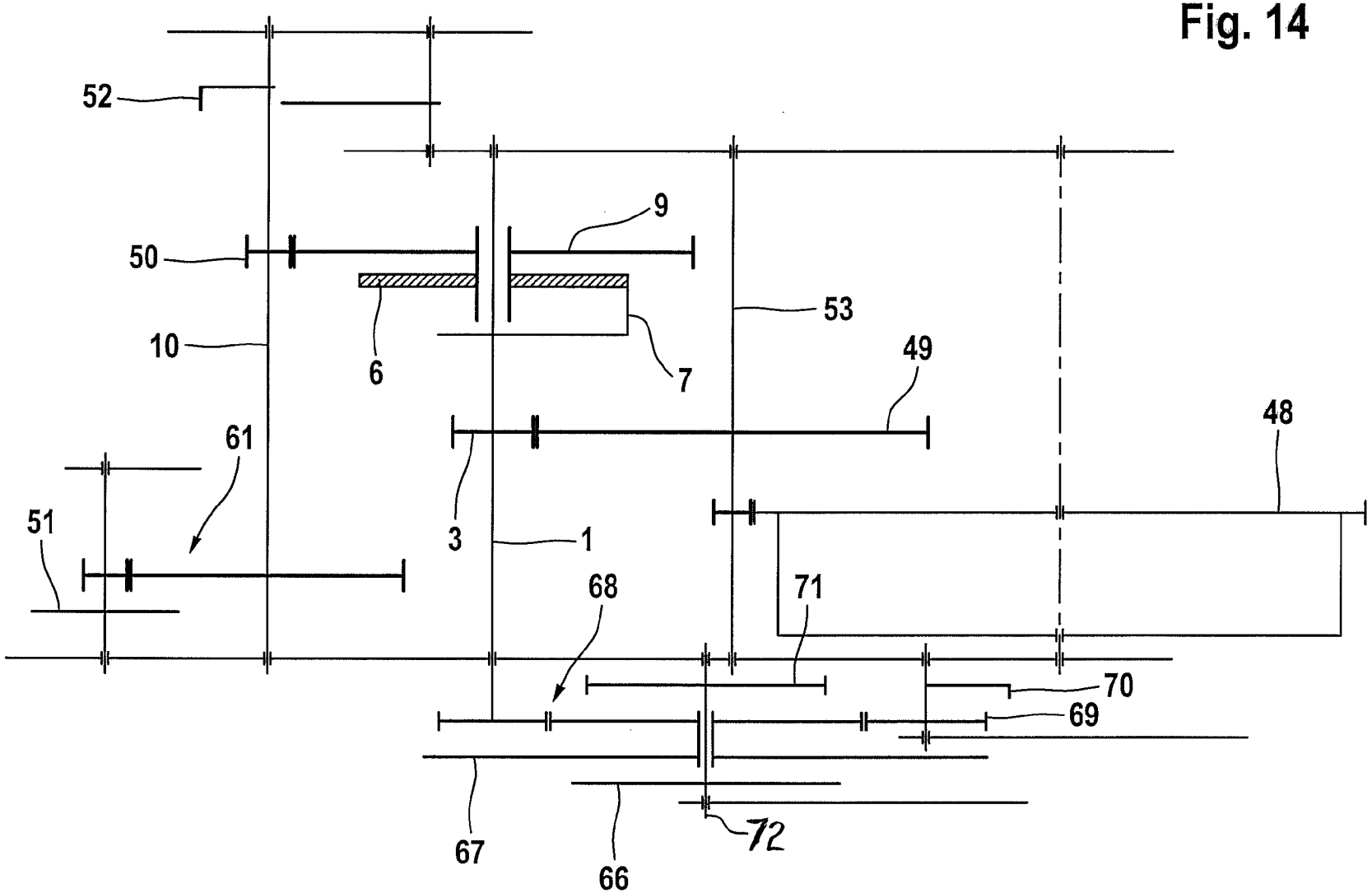
FIG. 14 is a schematic representation of the drive mechanism of a digital-display timepiece.

The tensioning mechanism depicted in FIGS. 1 to 10 has a drive spindle 1, which is preferably driven rotatably in cyclic steps by a mainspring (not shown) of a barrel 48 (shown schematically in FIGS. 12-14).

Fixedly disposed on the drive spindle 1 is a pinion 2, by which a minute wheel 73 is rotatably driven.

A first third wheel 3 is likewise fixedly disposed on the drive spindle 1 and engages with a drive wheel 5 disposed on a second spindle 4 parallel to the drive spindle 1.

Arranged around the drive spindle 1 is a storage hairspring 6 that is connected at its outer ends, by means of an outer spiral fastener 7, to the first third wheel 3.

The storage hairspring 6 is fixedly connected at its inner end to a hub 8 of a second third wheel 9, which by means of the hub 8 is mounted rotatably on the drive spindle 1.

By means of the second third wheel 9, first spindle 10, bearing a second wheel 11, is driven in a continuously rotatable manner. The second wheel 11 is in engagement with a pinion gear 35 of an anchor wheel 36 of an escapement of the oscillating system of the timepiece.

At one free end region of the first spindle 10, a disc spring 13 is supported by its centric region against a shoulder of the first spindle 10. The disc spring bears with its radially outer peripheral region with pretensioning against a radial widening 14 of a support part 12 arranged in a freely rotatable manner on the first spindle 10, forming a friction coupling.

The support part 12 is supported by its end face facing away from the disc spring 13 against a further shoulder of the first spindle 10.

Parallel to the first spindle 10, an impulse pin 15 is disposed on the radial widening 14.

In a plane parallel to the radial plane of the impulse pin 15, the support part 12 is configured at its end facing away from the disc spring 13 as a blade roller 16 with curve 17 running concentrically to the first spindle 10. The blade roller 16 preferably has a cutout 18 over a portion of its periphery.

The impulse pin 15 is here disposed on one transition region from the cutout 18 to the curve 17.

Mounted pivotably about a pivot axis 19 parallel to the first spindle 10 is a three-armed lever 20. The first arm 21 has at its free end a fork 22, into which the impulse pin 15 can be moved upon rotation of the first spindle 10 and pivots the lever 20 out of a first end setting into a second end setting, whereupon it then moves back out of the fork 22.

The lever 20 is pressurized by a spring arm 23 in its first end, the first end setting being defined by a stop against which the lever 20 comes to bear.

The stop comprises a rotatably adjustable eccentric 24, so that the first end setting is adjustable.

At the free end of a second arm 25 of the lever 20 there is disposed a first blocking element configured as a first pallet 26. At the free end of a third arm 27 there is disposed a second blocking element configured as a second pallet 28.

In the first end setting of the lever 20, the first pallet 26 is pivoted into the tooth peripheral region of a tooth 29 of a single-toothed first wheel 30 disposed on the second spindle 4.

In the second end setting of the lever 20, the first pallet 26 is located outside the tooth peripheral region of the tooth 29, whilst the second pallet 28 is pivoted into the tooth peripheral region of a tooth of a second single-toothed wheel 32 disposed on a third spindle 33 parallel to the first spindle 10.

In the first end setting, the second pallet 28 is located outside the tooth peripheral region of the tooth 31 of the second wheel 32.

The third spindle 33 bears a second drive wheel 34, which can be rotatably driven by the first third wheel 3.

The first wheel 30 is adjustable rotatably about the second spindle 4, and the second wheel 32 is adjustable rotatably about the third spindle 33.

In the first end setting of the lever 20, the first wheel 30 is prevented from rotating by the bearing contact of the tooth 29 against the first pallet 26.

Thus, the first third wheel 3, too, is blocked by means of the second spindle 4 and the drive wheel 5, with the result that the mainspring of the barrel cannot drive the first third wheel 3 to tension the storage hairspring 6.

By means of the second third wheel 9, acted upon by the storage hairspring 6, a continuous rotary drive of the first spindle 10 and the impulse pin 15 is realized under the control of the oscillating system.

The tensioning mechanism is controlled by the oscillating system of the timepiece.

In this case, the impulse pin 15 engages in the fork 22 and, with this, pivots the lever 20 out of its first end setting in the direction of its second end setting.

The first pallet 26 is thereby moved out of the tooth peripheral region of the tooth 29 and the first wheel released.

Simultaneously, the second pallet 28 is moved into the tooth peripheral region of the tooth 31.

Under the tension of the mainspring of the barrel, a brief rotation of the drive spindle 1 and, with it, the first third wheel 3 ensues.

By means of the second drive wheel 34, the third spindle 33 is hereupon rotated to the point where the tooth 31 comes to bear against the second pallet 28.

Following further pivoting of the lever 20 by the impulse pin 15, the impulse pin 15 moves gradually back out of the fork 22 so as to disengage therefrom once the transportation by a positioning edge 37 of the impulse pin 15 has ended.

As a result of the relatively high force of the spring arm 23, the lever 20 is pivoted rapidly out of its second end setting into its first end setting, whereupon the first pallet 26 is moved into the tooth peripheral region of the tooth 29 and the second pallet 28 is moved out of the tooth peripheral region of the tooth 31.

Under the tension of the mainspring of the barrel 48, a rotary driving of the drive spindle 1 and of the first third wheel 3, as well as of the first wheel 30 and of the second wheel 32, ensues, until the tooth 29 of the first wheel 30 butts against the first pallet 26 and blocks a further rotation of the first wheel 30 and, with it, the first third wheel 3.

The rotation of the first third wheel 3 and of the outer spiral fastening 7 gives rise to a cycle of tensioning of the storage hairspring 6, by which, via the second wheel 11, the escapement and the oscillating system are continuously driven.

In the plane of the blade roller 16, a blade part 38 projects parallel to the fork 22 in the direction of longitudinal extent of the first arm 21, which, during the phase encompassing the first end setting of the lever 20, slides with its tip along the curve 17.

The lever 20 is thereby prevented from being able in this phase, to move inadvertently out of its first end setting. This could otherwise happen as a result of vibrations.

On the third spindle 33, parallel to the second wheel 32, there is disposed a damping wheel 39, which engages in a pinion gear 40 on a vane axis 41 bearing a fly-vane 42.

Since the fly-vane 42 is driven in the tensioning motion. The tensioning motion is realized in a dampened manner, so that a hard abutment of the teeth 29 and 31 against the pallets 26 and 28, and rebound motions, preferably do not occur.

On the first third wheel 3, parallel to the drive spindle 1, there is disposed a stop pin 43, which juts into a concentric long hole 44 of the second third wheel 9 and thus limits the relative twistability of the two third wheels 3 and 9 to one another. The timepiece can continue to run when the storage hairspring 6 can no longer be tensioned.

If the force of the mainspring of the barrel is reduced such that it can no longer fully tension the storage hairspring 6, the lever 20 seated with its second pallet 28 on a radially circumferential blocking face 45 of the second wheel 32 stops the clockwork movement by means of the impulse pin 15 and the second wheel 11. Malfunctions are thereby prevented.

Figure 1:
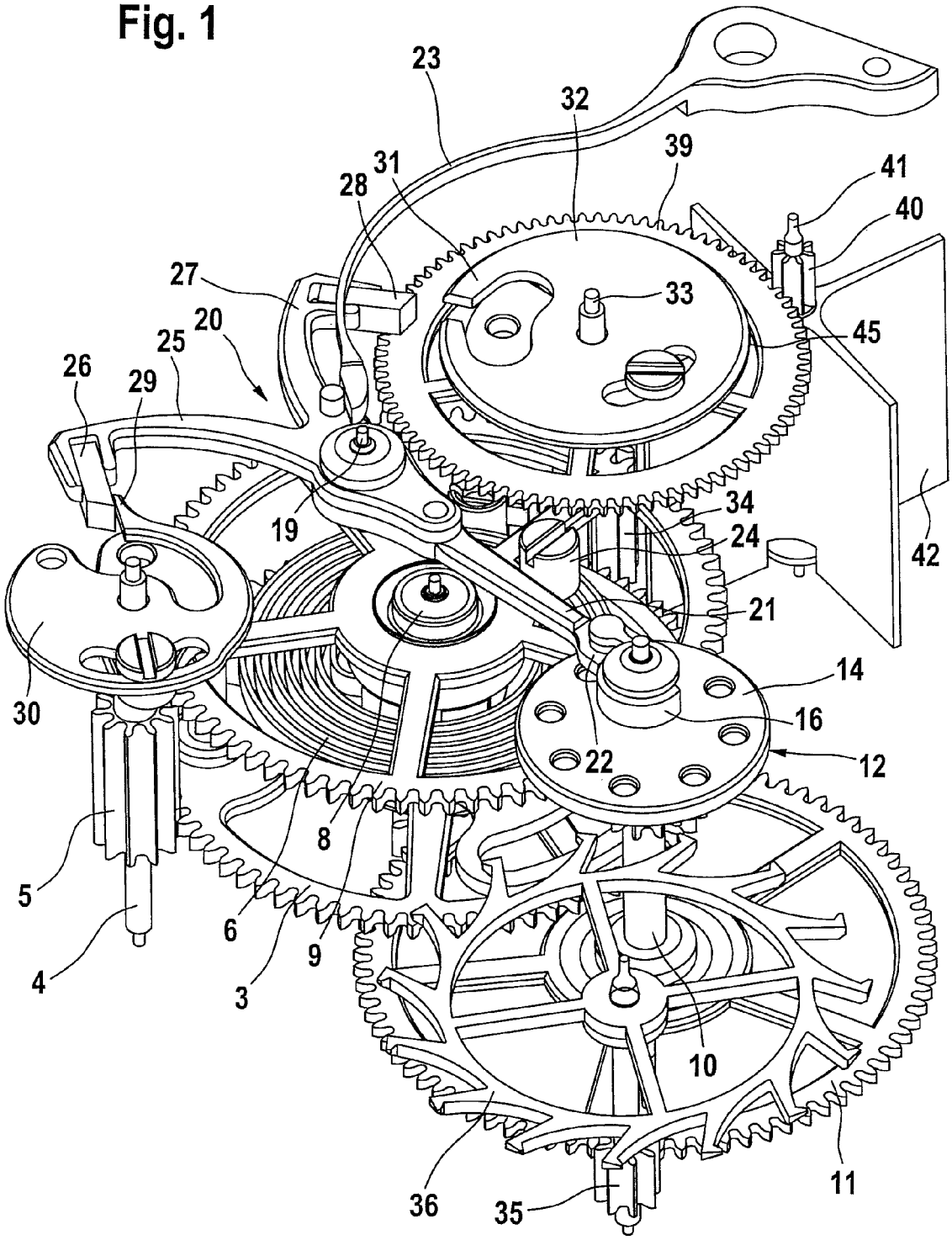
FIG. 1 is a perspective view of a tensioning mechanism according to one embodiment of the invention.
Figure 2:
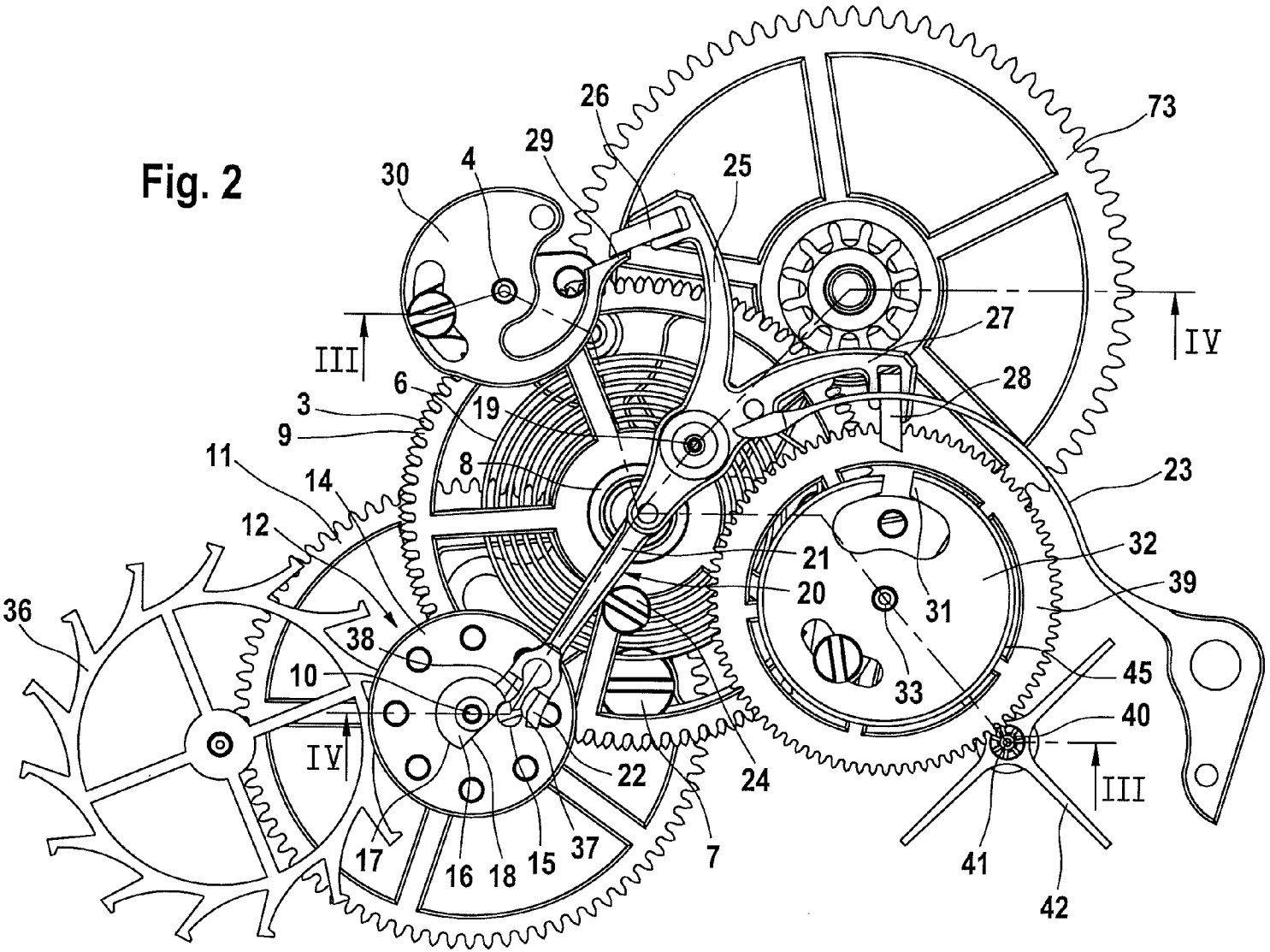
FIG. 2 is a top view of the tensioning mechanism according to FIG. 1.
Figure 3:
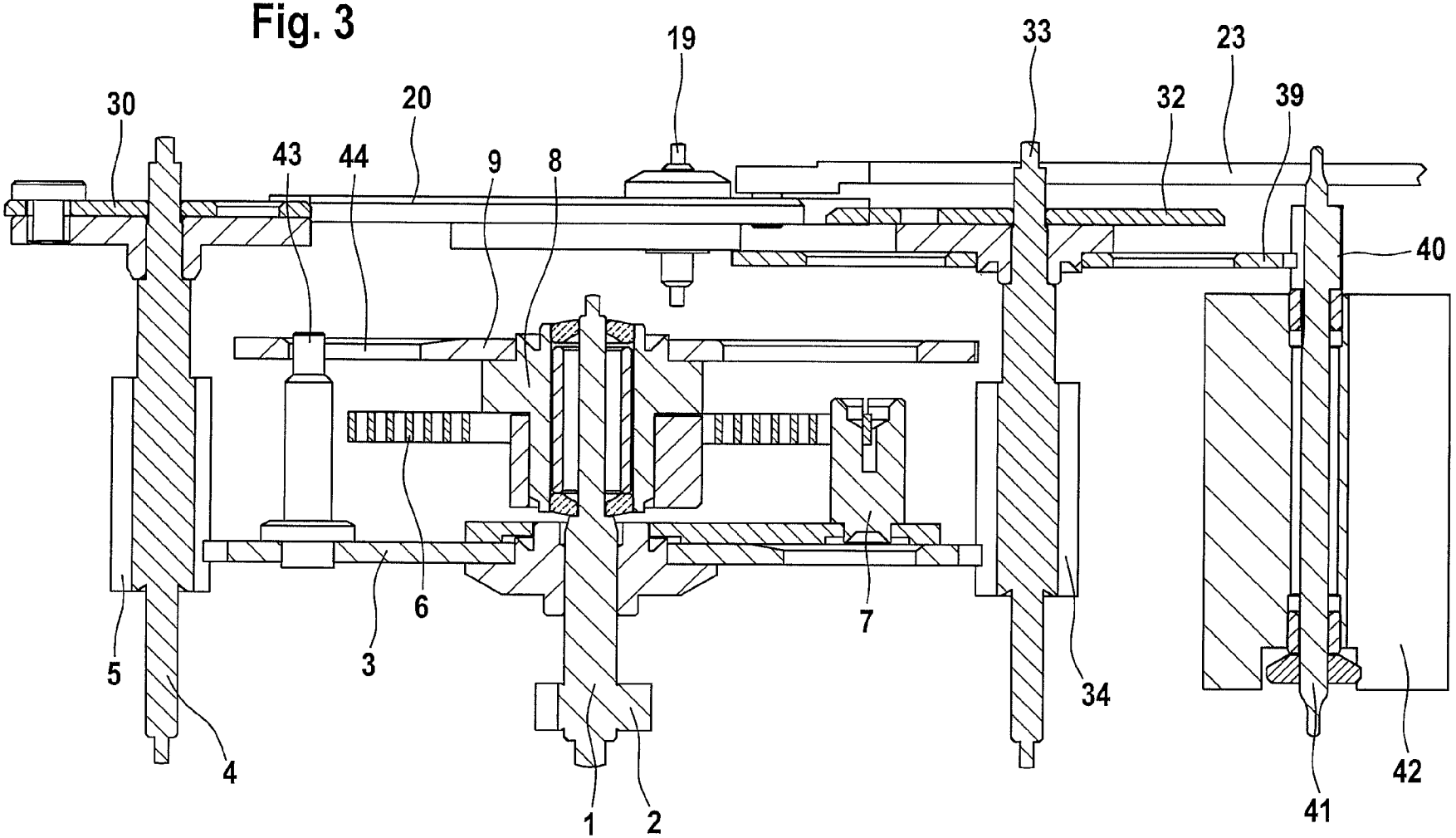
FIG. 3 is a cross-section along the line III-III in FIG. 2.
Figure 4:
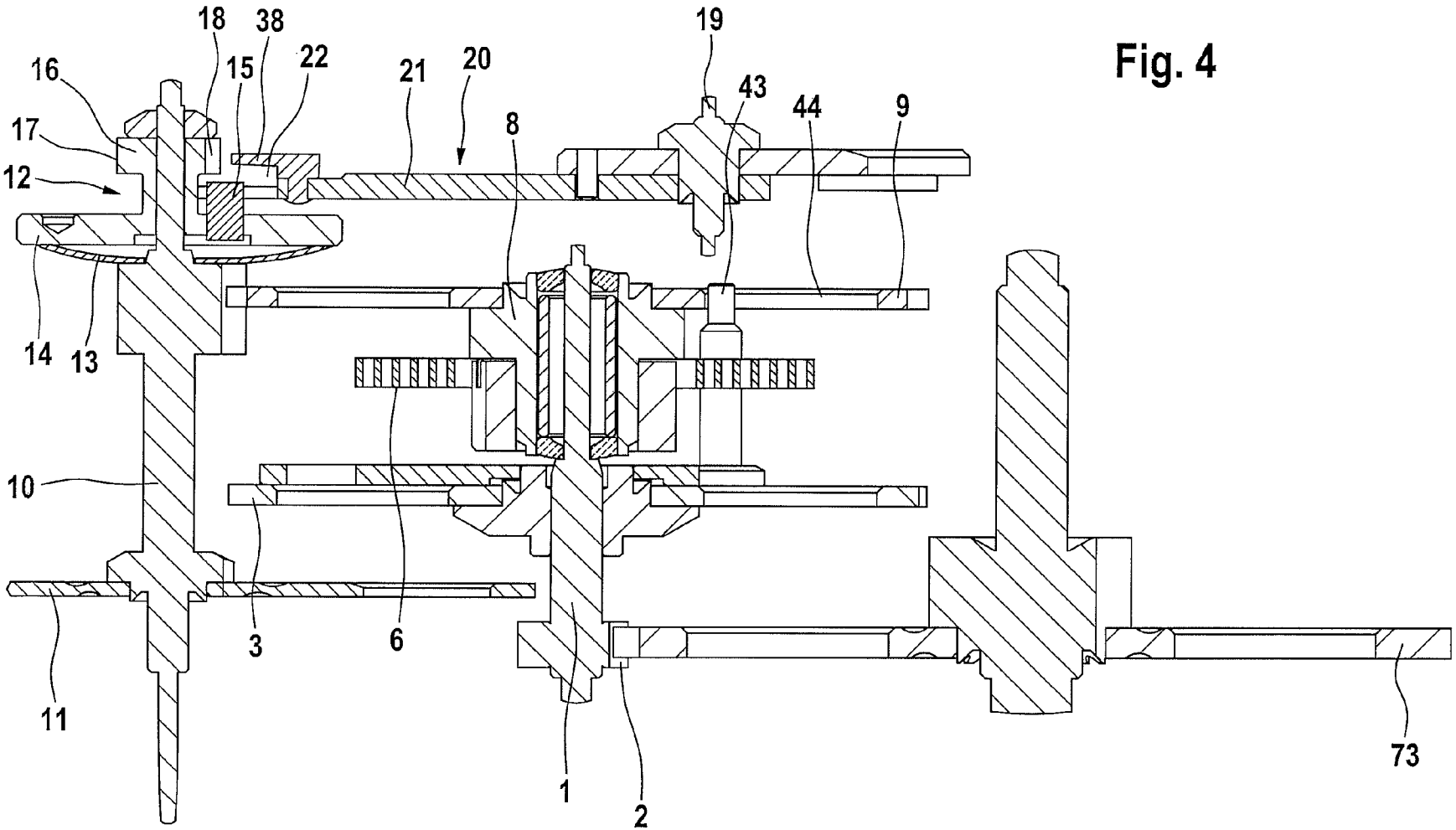
FIG. 4 is a cross-section along the line IV-IV in FIG. 2.
Figure 6:
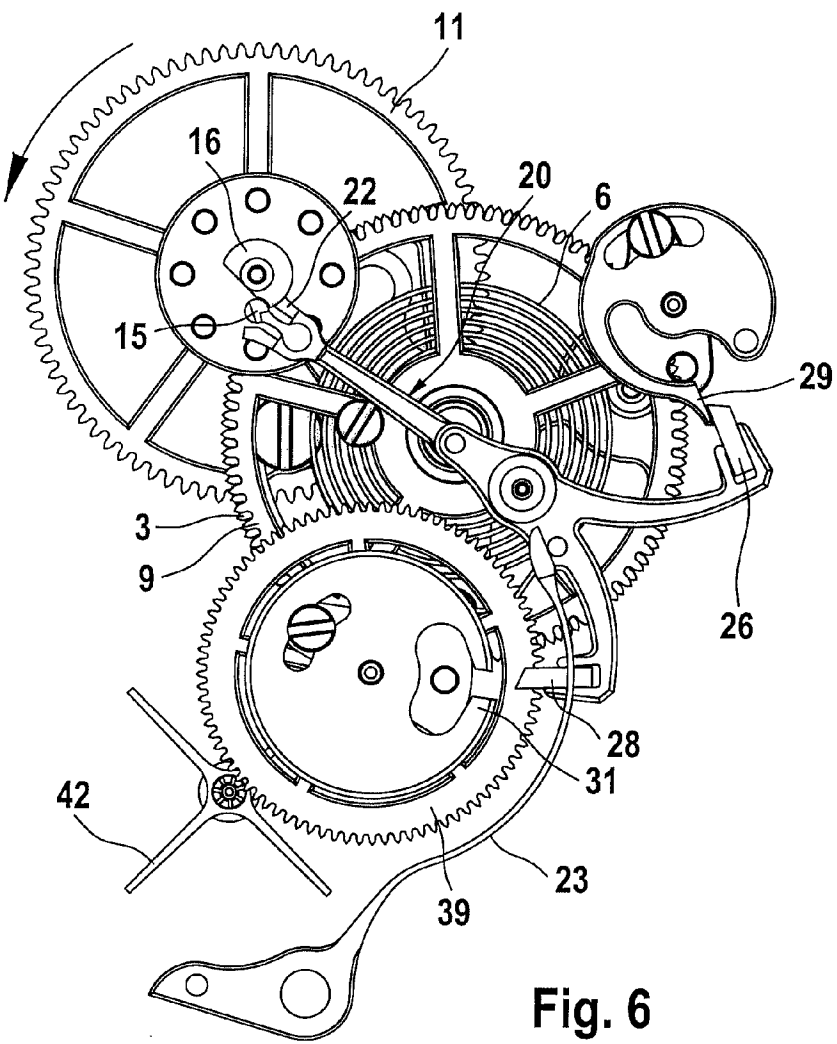
FIG. 6 is a top view of the tensioning mechanism according to FIG. 1 in a second process setting.
Figure 5:
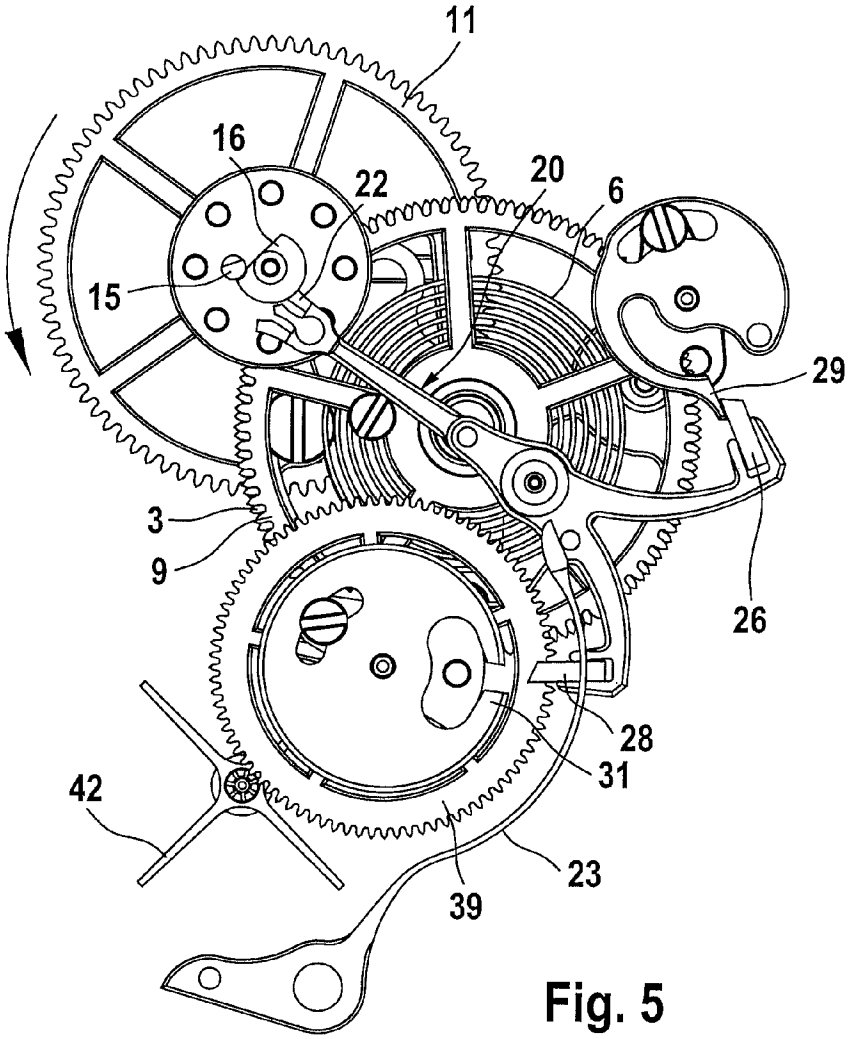
FIG. 5 is a top view of the tensioning mechanism according to FIG. 1 in a first process setting.
Figure 8:
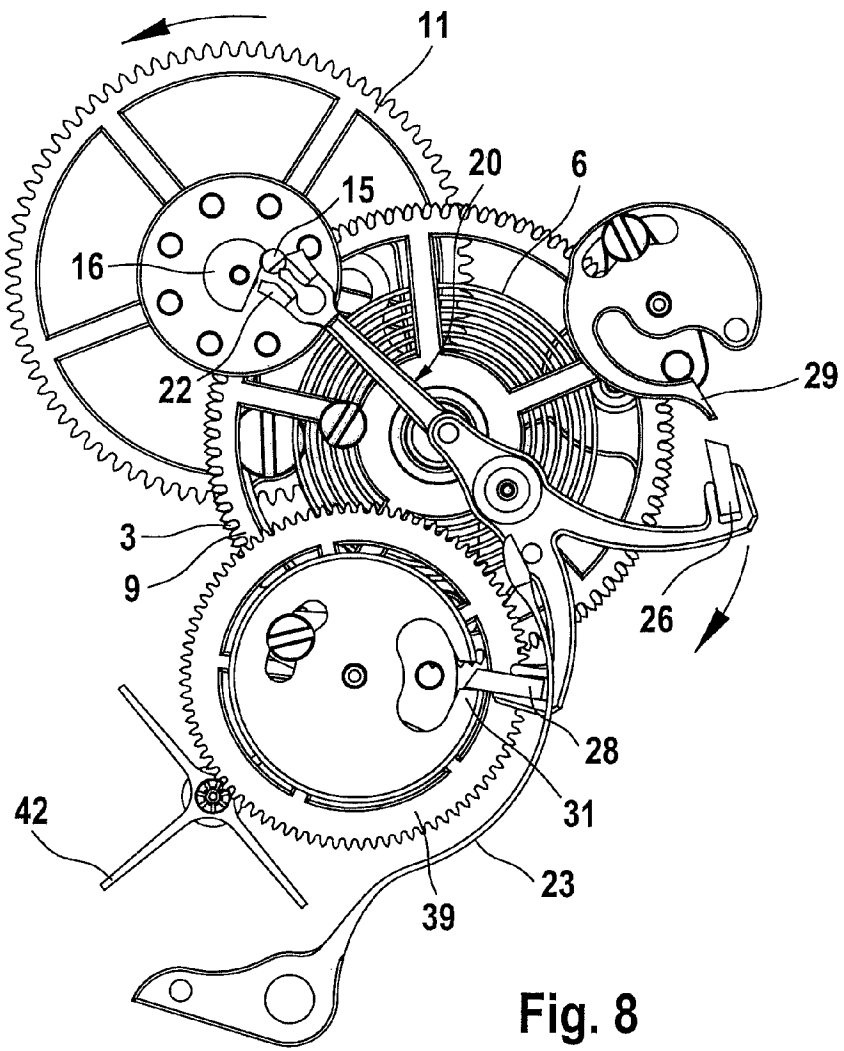
FIG. 8 is a top view of the tensioning mechanism according to FIG. 1 in a fourth process setting.
Figure 7:
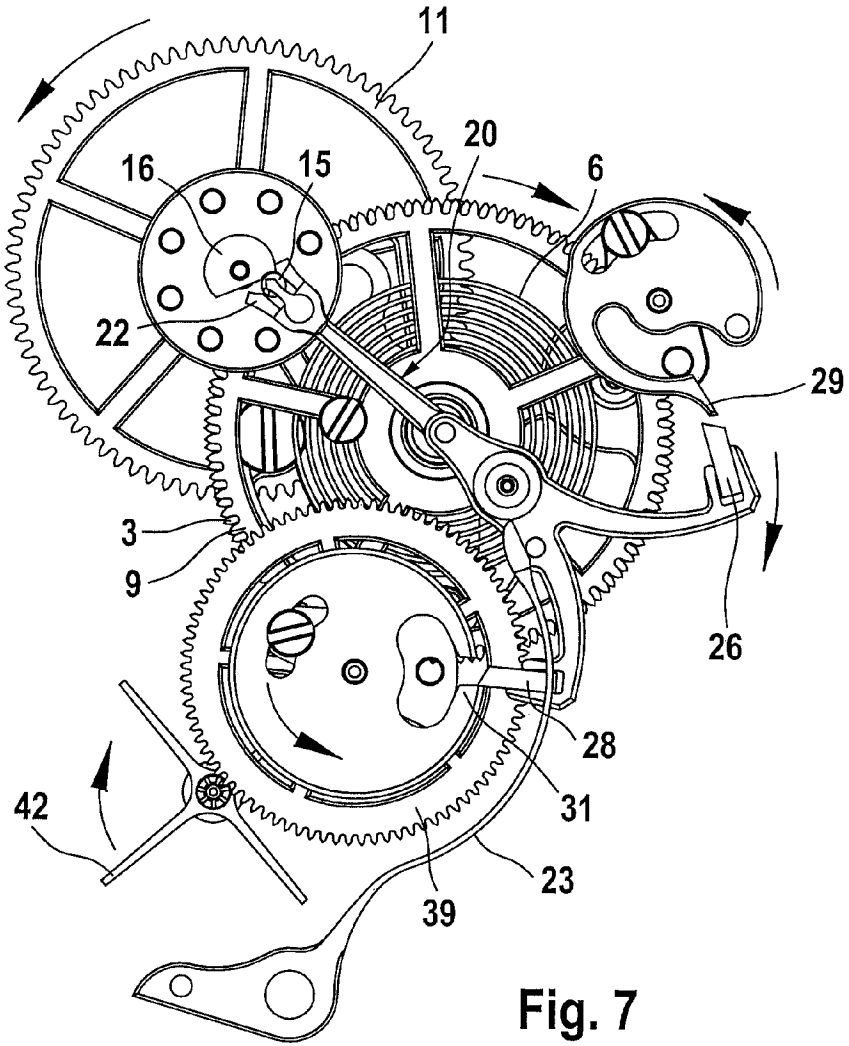
FIG. 7 is a top view of the tensioning mechanism according to FIG. 1 in a third process setting.
Figure 10:
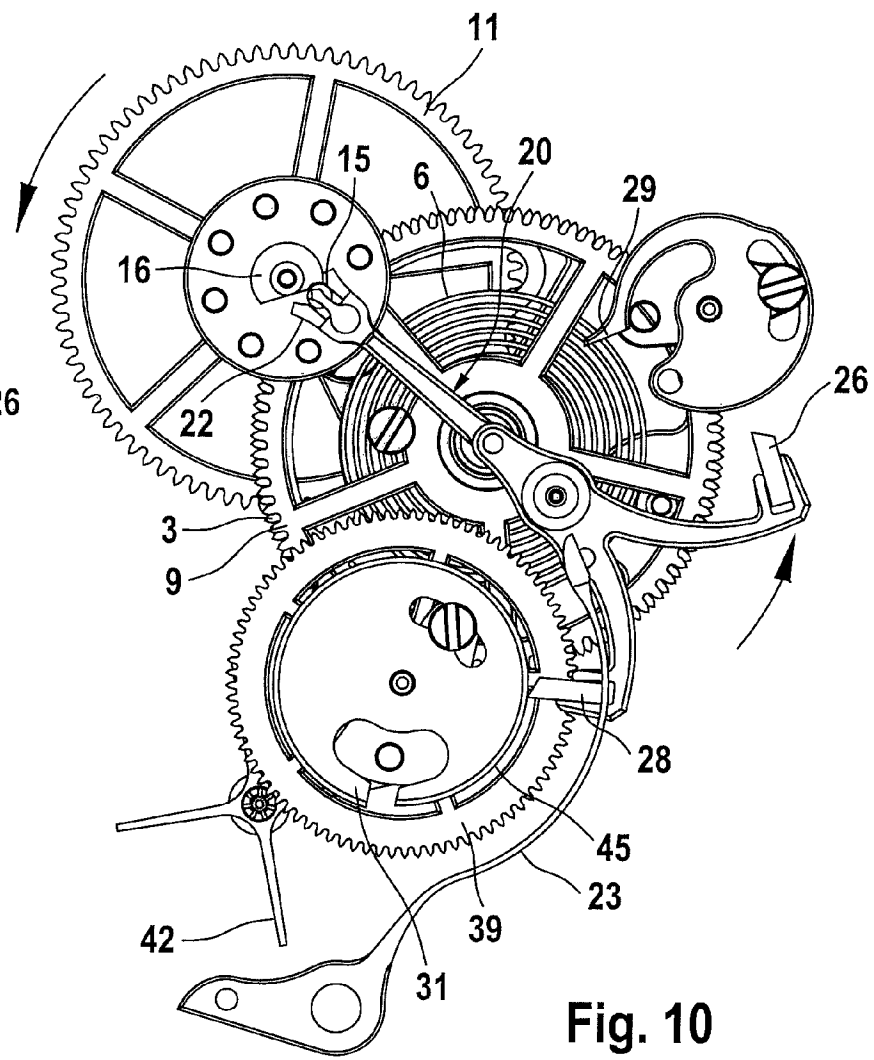
FIG. 10 is a top view of the tensioning mechanism according to FIG. 1 in a blocking setting.
Figure 9:
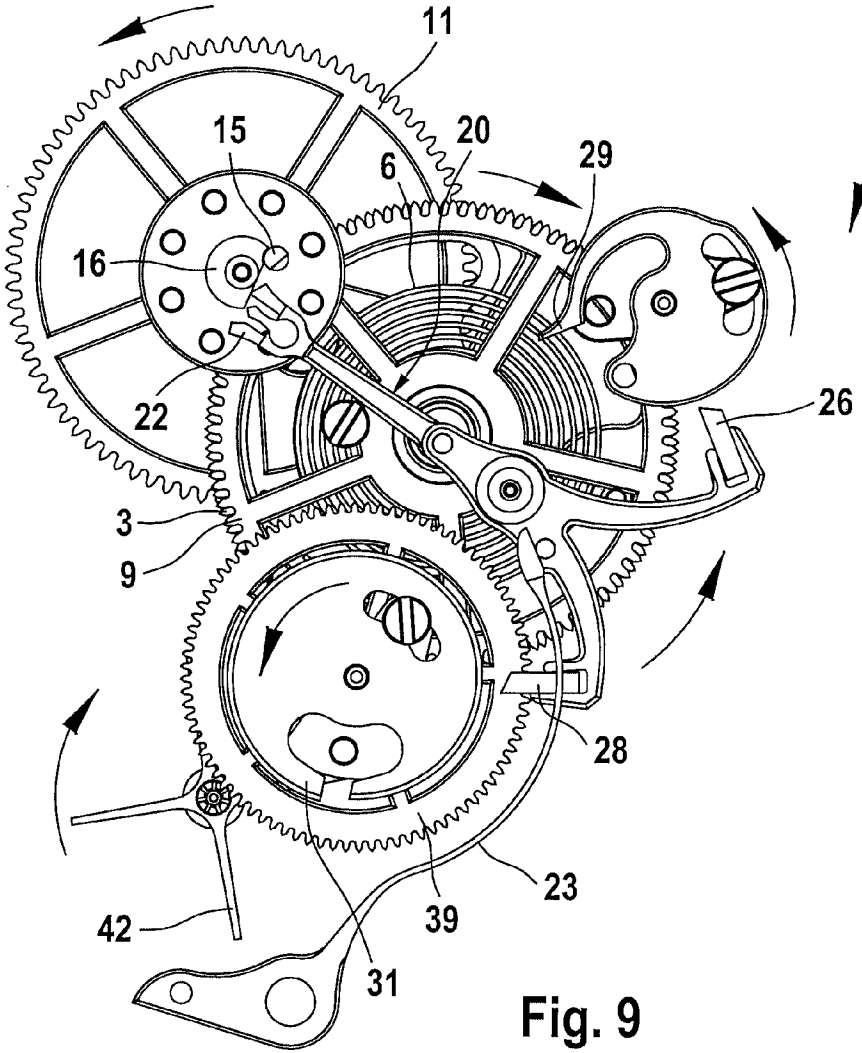
FIG. 9 is a top view of the tensioning mechanism according to FIG. 1 in a fifth process setting.
Figure 11:
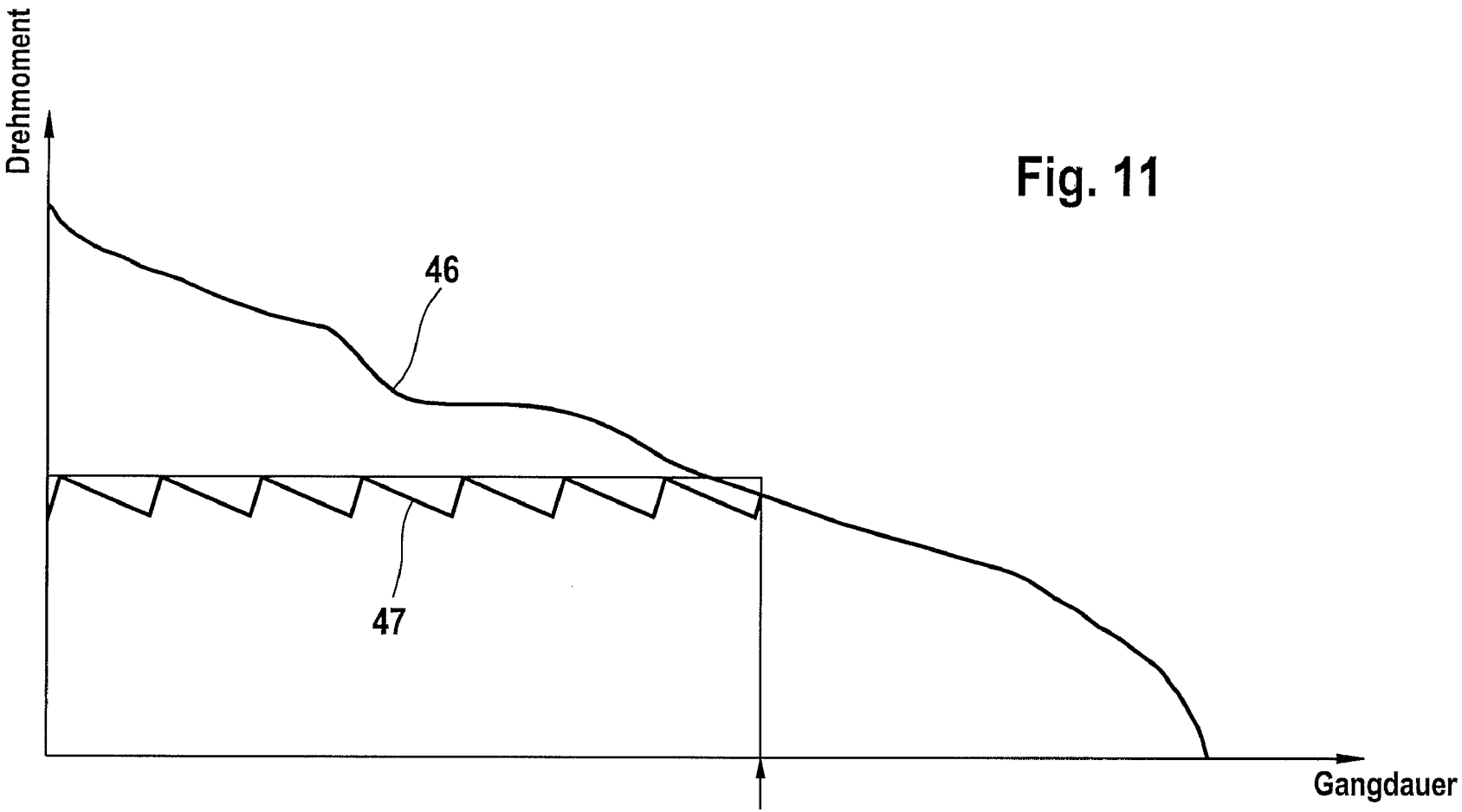
FIG. 11 is a graph of the torque over the running period.

In FIG. 11, the torque supplied to the oscillating system of the timepiece is applied over the running period of the timepiece. Here, the curve 46 shows the torque delivered by the mainspring of the barrel. Curve 47 shows the torque delivered by the tensioning mechanism up to the maximum running period of a timepiece with tensioning mechanism.

From the curve 46, it can here be seen that the torque provided by the mainspring is subject to heavy fluctuations. The cause of this can be, for example, a long period of running of the timepiece, or components of the timepiece which are additionally driven by the barrel and have a fluctuating torque requirement.

As shown by the curve 47, these torque fluctuations are eliminated by the tensioning mechanism, whereby the accuracy of the timepiece is improved.

In the illustrative embodiments of FIGS. 12 to 14, the drive spindle 1 and the first third wheel 3 are driven, in accordance with the illustrative embodiment of FIGS. 1 to 10, by a barrel 48 via an intermediate wheel 49 disposed on a spindle 53.

The storage hairspring 6 is tensioned cyclically by means of the outer spiral fastening 7. The second third wheel 9 being continuously driven by the storage hairspring 6. Second third wheel 9 drives a wheel 50 disposed on the first spindle 10.

An escapement 51 of the oscillating system of the timepiece is driven via a gear mechanism 61 on the first spindle 10.

The first spindle 10 bears a control element 52 for actuating a tensioning control system (not represented), in one embodiment corresponding to the tensioning control system of the illustrative embodiment of FIGS. 1 to 10, by which the tensioning mechanism can be driven rotatably in a controlled manner in cyclic steps.

In FIG. 12, arranged on the spindle 53, revolving therewith, is a minute detent spring 54, which engages with a minute detent 55 in the tooth spaces of a 60-tooth minute ratchet wheel 56 bearing a minute hand 60. The minute ratchet wheel 56 is driven, via the spindle 53 and the minute detent 55 engaging in the tooth spaces of the minute ratchet wheel 56, by the barrel 48.

If the minute hand 60 is displaced by a device (not represented), for example for correction purposes, the minute detent 55 latches over the teeth of the minute ratchet wheel 56. Since the minute detent 55, after the end of this displacement operation, re-engages in a tooth space of the minute ratchet wheel 56, a displacement is possible only exactly in full minute steps.

An hour wheel 59 bearing an hour hand 58 can be driven rotatably at one revolution per hour by the minute ratchet wheel 56 via a change gear 57.

In this case, the minute hand 60 jumps in minute steps in accordance with the cyclic tensioning steps of the tensioning mechanism.

In FIG. 13, the first spindle 10 bears a minute hand 60', which is continuously driven by the tensioning mechanism.

Connected to the barrel 48, rotating in 144 cyclic 5-minute steps, is a pinion 62, which bears an hour detent spring 63 revolving with the pinion 62.

In this case, the hour detent spring 63 engages with an hour detent 64 in the tooth spaces of a 144-tooth hour ratchet wheel 65, which is disposed on an hour pinion 74 bearing an hour hand 58'.

The hour pinion 74 is driven by the barrel 48 via the pinion 62 and via the hour detent 64 engaging in the tooth spaces of the hour ratchet wheel 65.

If the hour hand 58' is displaced by a device (not represented), for example for correction purposes, the hour detent 64 latches over the teeth of the hour ratchet wheel 65. Since the hour detent 64, after the end of this displacement operation, re-engages in a tooth space of the hour ratchet wheel 65, a displacement is possible only exactly in full 5-minute steps.

In FIG. 14, the minutes are indicated as jumping minutes with digits, which are composed of tens digits disposed on a tens-digit dial 66 and units digits disposed on a units-digit dial 67.

The units-digit dial 67 is driven by the drive spindle 1 in sixty cyclic steps per hour via a transmission step 68.

By the transmission step 68, an intermediate wheel 69 is driven, which bears a control element 70 by which an indexing gear 71 can be advanced in six steps per hour, the indexing gear 71 being disposed on a tens shaft 72 bearing the tens-digit dial 66.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps, which perform substantially the same function in substantially the same way to achieve the same results, are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

I claim:

1. A timepiece comprising:

a main energy storing device;

a gear train coupled to the main energy storing device;

a tensioning element coupled to the gear train, the tensioning element configured to be driven about a tensioning axis by the main energy storing device through the gear train;

a tensioning control system configured to control the tensioning element so that the tensioning element is driven in cyclic steps;

a storage hairspring having a first end and a second end, the first end connected to the tensioning element;

a wheel connected to the second end of the storage hairspring;

a clockwork movement rotatably driven by the wheel;

an escapement coupled to the wheel; and a device configured to be switched in a stepwise manner and driven rotatably in cyclic steps by an element of the gear train.

2. The timepiece according to claim 1, wherein a minute wheel is driven rotatably in cyclic steps directly or indirectly by the element of the gear train.

3. The timepiece according to claim 2, wherein the tensioning element is driven rotatably in a cyclic manner in minute steps and the device configured to be switched is a minute hand drive comprising a minute pinion bearing a minute hand configured to be driven rotatably in 6° steps.

4. The timepiece according to claim 3, wherein the minute pinion bears a 60-tooth minute ratchet wheel and a minute detent of a minute detent spring is engageable in tooth spaces of the minute ratchet wheel.

5. The timepiece according to claim 3, further comprising an hour wheel bearing an hour hand and a change gear, wherein the minute pinion bears a gearwheel, drivably connected to the change gear, the hour wheel bearing an hour hand is driven rotatably at one revolution per hour by the gearwheel and change gear.

6. The timepiece according to claim 1, further comprising an hour wheel configured to be driven rotatably in cyclic steps directly or indirectly by the element of the gear train.

7. The timepiece according to claim 6, wherein an hour pinion is driven rotatably by the main storing device in 144 cyclic 5-minute steps of 2.5°.

8. The timepiece according to claim 6, wherein an hour cannon is driven rotatably by the main storing device in 72 cyclic 10-minute steps of 5°.

9. The timepiece according to claim 1, wherein the device comprises a numerical dial of a digital time display driven rotatably in cyclic steps directly or indirectly by the element of the gear train.

10. The timepiece according to claim 1, wherein the main energy storing device is a barrel.

11. The timepiece according to claim 1, wherein the tensioning element is a first third wheel and the wheel rotatably driving the clockwork movement is a second third wheel, which is arranged coaxially to the first third wheel that is rotatable by a limited angle relative to the first third wheel.

12. The timepiece according to claim 11, wherein a wheel of the clockwork movement is disposed in a rotationally secure manner on a first spindle and is driven rotatably by the second third wheel, the first spindle bearing a control element configured to actuate a control part of the tensioning control system, which is engageable in a gearwheel that engages the first third wheel.

13. The timepiece according to claim 12, further comprising:

an impulse pin arranged on the first spindle that rotates with the first spindle; and a lever comprising a first arm, a second arm, and a third arm, the first arm having a fork configured to engage the impulse pin, wherein the lever is pivotable about a pivot axis out of a first end setting into a second end setting, parallel to the first spindle, counter to a spring force in response to the impulse pin engaging in the fork, the second arm of the lever having a first blocking element that is pivotable into a tooth peripheral region of one of the teeth of one of a first single-toothed and a multi-toothed wheel, the third arm of the lever, having a second blocking element that is pivotable into the peripheral region of teeth of at least one of a second single-toothed and a multi-toothed wheel, the first wheel and the second wheel are driven rotatably by the first third wheel, wherein in the first end setting of the lever the first blocking element is pivoted into the tooth peripheral region of the first wheel and the second blocking element is pivoted out of the tooth peripheral region of the second wheel, and wherein in the second end setting of the lever the second blocking element is pivoted into the tooth peripheral region of the second wheel and the first blocking element is pivoted out of the tooth peripheral region of the first wheel.

14. The timepiece according to claim 13, wherein the impulse pin on the first spindle is adjustable by twisting.

15. The timepiece according to claim 14, wherein the impulse pin is connected to the first spindle by a friction coupling.

16. The timepiece according to claim 13, wherein the impulse pin has a positioning edge parallel to the first spindle by which the fork is pivotably acted upon.

17. The timepiece according to claim 13, further comprising a blade part that extends in the longitudinal extend of the level, the blade part includes a curve portion and is rotationally securely connected with the impulse pin wherein the free end of the first arm of the lever, bears against the curve of the handle part while the fork is free from action by the impulse pin.

18. The timepiece according to claim 13, wherein the second wheel drives a rotation-damping device.

* * * * *